US010000223B2

(12) United States Patent
Moeller

(10) Patent No.: US 10,000,223 B2
(45) Date of Patent: Jun. 19, 2018

(54) RAIL TRACK GEOMETRY MEASUREMENT

(71) Applicant: Tech Services Group, LLC, Lakemoor, IL (US)

(72) Inventor: Richard B. Moeller, Mundelein, IL (US)

(73) Assignee: Tech Services Group, LLC, Lakemoor, IL (US)

( * ) Notice: Subject to any disclaimer, the term of this patent is extended or adjusted under 35 U.S.C. 154(b) by 119 days.

(21) Appl. No.: 15/266,240

(22) Filed: Sep. 15, 2016

(65) Prior Publication Data

US 2017/0080960 A1 Mar. 23, 2017

Related U.S. Application Data

(60) Provisional application No. 62/220,447, filed on Sep. 18, 2015.

(51) Int. Cl.

| | |
|---|---|
| ***B61K 9/00*** | (2006.01) |
| ***B61L 25/02*** | (2006.01) |
| ***B61L 23/04*** | (2006.01) |
| ***B61L 27/00*** | (2006.01) |

(52) U.S. Cl.

CPC ..... *B61L 25/025* (2013.01); *B61L 23/047* (2013.01); *B61L 23/048* (2013.01); *B61L 27/0088* (2013.01); *B61L 2205/04* (2013.01)

(58) Field of Classification Search

CPC .... B61L 25/025; B61L 23/047; B61L 23/048; B61L 27/0088

USPC ..... 33/1 Q, 523, 523.1

See application file for complete search history.

(56) References Cited

U.S. PATENT DOCUMENTS

| | | | | |
|---|---|---|---|---|
| 1,751,393 | A * | 3/1930 | Busby | E01B 35/02 33/338 |
| 2,286,456 | A * | 6/1942 | Boettcher | E01B 35/04 33/523.1 |
| 6,725,782 | B1 * | 4/2004 | Bloom | B61K 9/08 104/2 |
| 2007/0203621 | A1 * | 8/2007 | Haugen | B61K 9/08 701/19 |
| 2015/0094885 | A1 * | 4/2015 | Dargy | B61L 23/047 701/19 |
| 2016/0368510 | A1 * | 12/2016 | Simon | B61D 15/12 |
| 2017/0106880 | A1 * | 4/2017 | Huelsmann | B61C 7/00 |
| 2017/0113707 | A1 * | 4/2017 | Ghaly | B61L 23/14 |
| 2017/0144680 | A1 * | 5/2017 | Fuchs | B61L 27/0005 |
| 2017/0305442 | A1 * | 10/2017 | Viviani | B61D 15/12 |

* cited by examiner

*Primary Examiner* — G. Bradley Bennett

(74) *Attorney, Agent, or Firm* — Fitch, Even, Tabin & Flannery LLP

(57) ABSTRACT

A rail gauge measurement tool includes a frame mounting the tool to a rail vehicle, and an engagement unit that moves relative to the frame. The engagement unit has a first contacting element that maintains contact with a rail as the vehicle moves along a rail track, and a pair of parallel connecting shafts. The tool also includes an air cylinder exerting a biasing force so that the engagement unit maintains contact with the rail as the vehicle travels along the rail track. The tool also includes a linear sensor, separate from the air cylinder, that measures movement of the first rail engagement unit relative to the frame. The linear sensor and the air cylinder are parallel, but in a different plane from the parallel connecting shafts to lend structural support to the tool.

20 Claims, 8 Drawing Sheets

RAIL TRACK GEOMETRY MEASUREMENT

RELATED APPLICATIONS

This application claims the benefit of U.S. Provisional application No. 62/220,447, filed Sep. 18, 2015, titled "Track Geometry Measurement System," which is hereby incorporated by reference in its entirety.

TECHNICAL FIELD

The present application generally relates to rail sensors and measurement. More specifically, the present application relates to equipment and techniques that measure railroad track geometry.

BACKGROUND

In order to assure for the safe passage of trains and railcars, the geometry of railroad tracks should operate within certain parameters. To ensure that the tracks remain within these parameters, specially equipped trucks travel the tracks to measure the track geometry. However, several factors can reduce the accuracy of existing track geometry measurement systems. For example, the measurement system may bend or deflect, or the rail measuring wheel may contact a superficial irregularity (e.g., a burr) near the crown of a rail that results in an erroneous measurement. Moreover, structural issues in the measurement systems can result in faulty measurements, or measurements that are not as precise or accurate as desired. As a result of these issues, present techniques do not provide measurement data that is sufficiently accurate and reliable to ensure an ideal level of rail safety.

SUMMARY

The present application describes a rail gauge measurement tool (RGM) that attaches to a rail mounted vehicle and measures railroad track geometry as the vehicle travels along the rail track. The RGM can be used to measure a variety of track geometry features including the geometry relationships from rail to rail or from rail to track bed, or the geometry of the rail itself.

In one example, the RGM includes a frame that mounts the RGM to a rail vehicle, and an engagement unit that moves relative to the frame. The engagement unit has a first contacting element that maintains contact with a rail as the vehicle moves along a rail track, and a pair of parallel connecting shafts. The RGM also includes an air cylinder, which exerts a biasing force so that the engagement unit maintains contact with the vehicle travels along the rail track. The RGM also includes a linear sensor, separate from the air cylinder, that measures movement of the first rail engagement unit relative to the frame. The linear sensor and the air cylinder are parallel, but in a different plane from the parallel connecting shafts to lend structural support to the RGM. In some examples, the air cylinder and linear sensor are parallel to one another, but are parallel in a plane that is different from the plane in which the parallel connecting shafts run parallel. In this way, the air cylinder may align with a midpoint between the two parallel shafts, such that forces from the air cylinder are transmitted more evenly to each shaft, thereby producing a stable, low friction linear displacement of the engagement unit.

Some examples described herein also include a system that includes an RGM (such as the RGM described above) along with an inertial navigation module in communication with the electronic sensor module. The inertial navigation module is configured to measure the orientation of the vehicle. The system also includes a location sensor (e.g., a GPS sensor or the like) that measures or monitors the location of the vehicle. The system also includes a processor or computer processing device that receives data or other information from the RGM, the inertial navigation module, the location sensor, and other sensors, and processes that data and/or transmits the data to a display or interface. The system includes (or is in communication with) a variety of other sensors and devices positioned at or around the rail vehicle or rail track, such as tilt sensors, accelerometers, motion sensors, heat sensors, cameras, radar, laser measurement devices, transceivers, data networks, data servers, and the like. Via these sensors, the system can obtain and process information pertaining to the rail vehicle and the rail track.

This application also describes methods for measuring rail track geometry. One method includes moving a vehicle along a track that has parallel rails. The method involves measuring various parameters pertaining to operating conditions of the rail and/or the railway track. An inertial navigation sensor measures the orientation of the vehicle about multiple axes, and a location sensor (e.g., a GPS unit) measures the location of the vehicle. A rail geometry measuring unit (e.g., the RGM unit described above) measures the geometry of one or more rails of the track. A processor gathers and processes the information, and then transmits the information (e.g., via a wireless transceiver) to a user interface or other display, whereby a user can receive and respond to the information. The measurement of the rail geometry includes contacting at least one of the rails with a rail contacting element, biasing the rail contacting element towards the rail, and measuring with a linear sensor the linear movement of the rail contacting element along an axis perpendicular to the rail.

DETAILED DESCRIPTION

Figure 1:
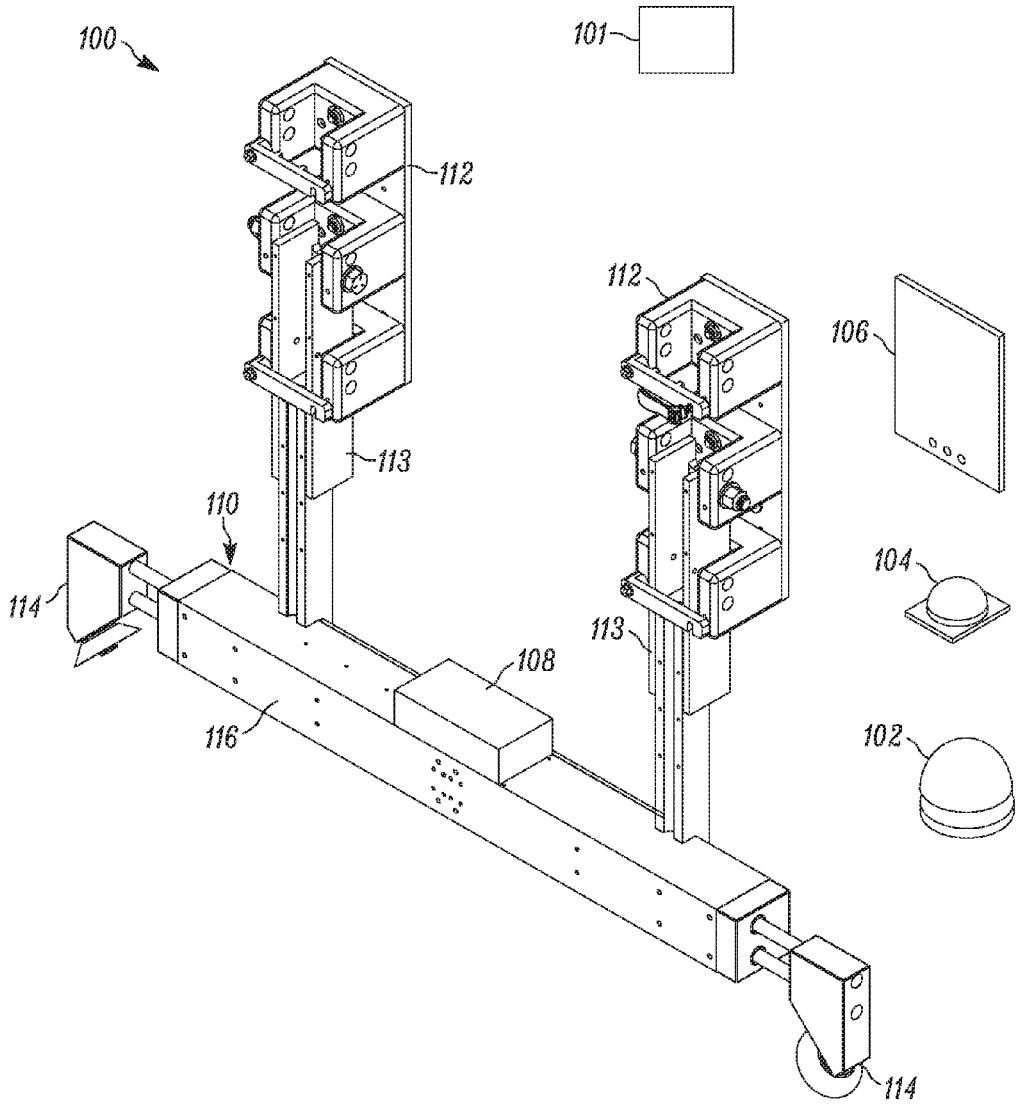
FIG. 1 shows a rail track geometry measurement system according to examples described in this application.

The present application describes various examples of a rail track geometry measurement system that can accurately measure rail track geometry, display the measurements to a user, and transmit the measurements to a central database. In some examples, the measurement system includes an inertial navigation module (INM), a GPS module (or other location detection device), and a rail gage measurement tool (RGM). An electronic sensor module (ESM) collects the measurements from these three subsystems and transmits the measurements to a user interface module and a remote server.

In some aspects, the RGM includes a pair of measuring wheels, each configured to ride along one of the parallel rails of a rail track. The measuring wheels are each slidably mounted to the RGM by a pair of parallel connecting shafts, and are biased towards the rail by an air cylinder. When the track geometry gage changes (e.g., when the distance between the rails increase or decrease), the measuring wheels slide in or out relative to the RGM. A linear sensor that extends parallel to the air cylinder within the RGM measures this sliding to obtain rail geometry measurement data.

The use of two parallel connecting shafts attached to each measuring wheel helps provide structural integrity and rigidity to the system. In this way, the two parallel shafts can provide greater integrity, stability, and rigidity than may otherwise be available from a single shaft model. The improved rigidity allows less room for vibrations or other undesired fluctuations in the motion of the tool sensors, and thereby increasing the measurement accuracy of the RGM.

As noted above, the RGM includes an air cylinder and a linear sensor as separate parallel components. The use of an air cylinder and linear sensor as separate components reduces the forces that are applied to each of the components. This, in turn, reduces the wear and tear on the components, and thereby extends the service life and improves the overall reliability of the RGM tool. This also allows the RGM tool to utilize a higher degree of resolution (i.e., a more sensitive) sensor capable of detecting smaller changes in the rail geometry.

The parallel cylinder/sensor and the parallel shafts of the rail engagement unit can be arranged so that they are not both parallel in the same plane. In some examples, the two planes are offset by 90 degrees so that they are perpendicular to one another. The air cylinder can also be arranged to align with the midpoint between the two parallel shafts. This arrangement can reduce, inhibit, and/ or minimize friction on the cylinder, the linear sensor, and the engagement unit, and also serves to increase the rigidity of the RGM itself. These features therefore contribute to improving the accuracy, reliability, and overall service life of the RGM itself.

As used herein, the term "coupled" refers to relationships between components that allows the two components to communicate with and/or mechanically affect one another. Two components may be considered "coupled" if they are directly or indirectly coupled to one another. For example, a first component may be considered "coupled" to a second component if factors that affect the first component (e.g., forces acting upon the first component, signals sent to the first component, etc.) are transmitted to the second component. Thus, two components may be considered "coupled" consistent with this application even if there are intervening components (e.g., bearings, plates, seals, shafts, etc.) between the two components.

As used herein, the term "superficial irregularities" refers to small physical details of a rail that are not significant to the overall rail geometry. For example, small burrs, bumps, gouges, and abrasions on a rail may constitute a superficial irregularity. These superficial irregularities can cause certain elements of the RGM tool to respond in a manner that results in a faulty or misleading measurement that does not affect the true geometry of the rail. Certain examples described herein are designed to limit or minimize the impact of such superficial irregularities from the overall measurements obtained by the RGM.

FIG. 1 illustrates a rail track geometry measurement system 100. The rail track geometry measurement system 100 comprises a plurality of sensors or sensor systems for measuring track geometry. FIG. 1 shows an inertial navigation module (INM) 102, a location sensor 104, and a rail gage measurement tool (RGM) 110. In other examples, additional sensors may be included, such as laser distance sensors that measure the distance between the body 116 of the RGM 110 and the track or track bed, or a speedometer configured to measure the speed of the vehicle.

The body 116 comprises a frame and a housing attached to said frame. The housing surrounds several components of the RGM 110, such as the linear sensors 122 and air cylinders 120. Other possible sensors to be included in the system 100 include multiple axis tilt sensors, accelerometers, digital cameras, infrared cameras, motion sensors, heat sensors, radar, transceivers, data networks, data servers, and the like. These sensors can be used to obtain and process information pertaining to the rail vehicle and the rail track. In some embodiments, one or more of the sensors are embedded in a potting material to protect the circuitry from impacts, vibration damage, and/or moisture.

The INM 102, location sensor 104, and RGM 110 are in communication with an electronics sensor module (ESM) 108. The ESM 108 receives data representing rail geometry from the INM 102, location sensor 104, and RGM 110 and transmits that data to a user interface module 106 and/or a remote server 101. In some examples, the INM 102, the location sensor 104, the RGM 110, and the ESM 108 are mounted on a rail vehicle that is designed to travel along rail tracks, such as a road-rail vehicle or hi-rail truck.

Figure 2:
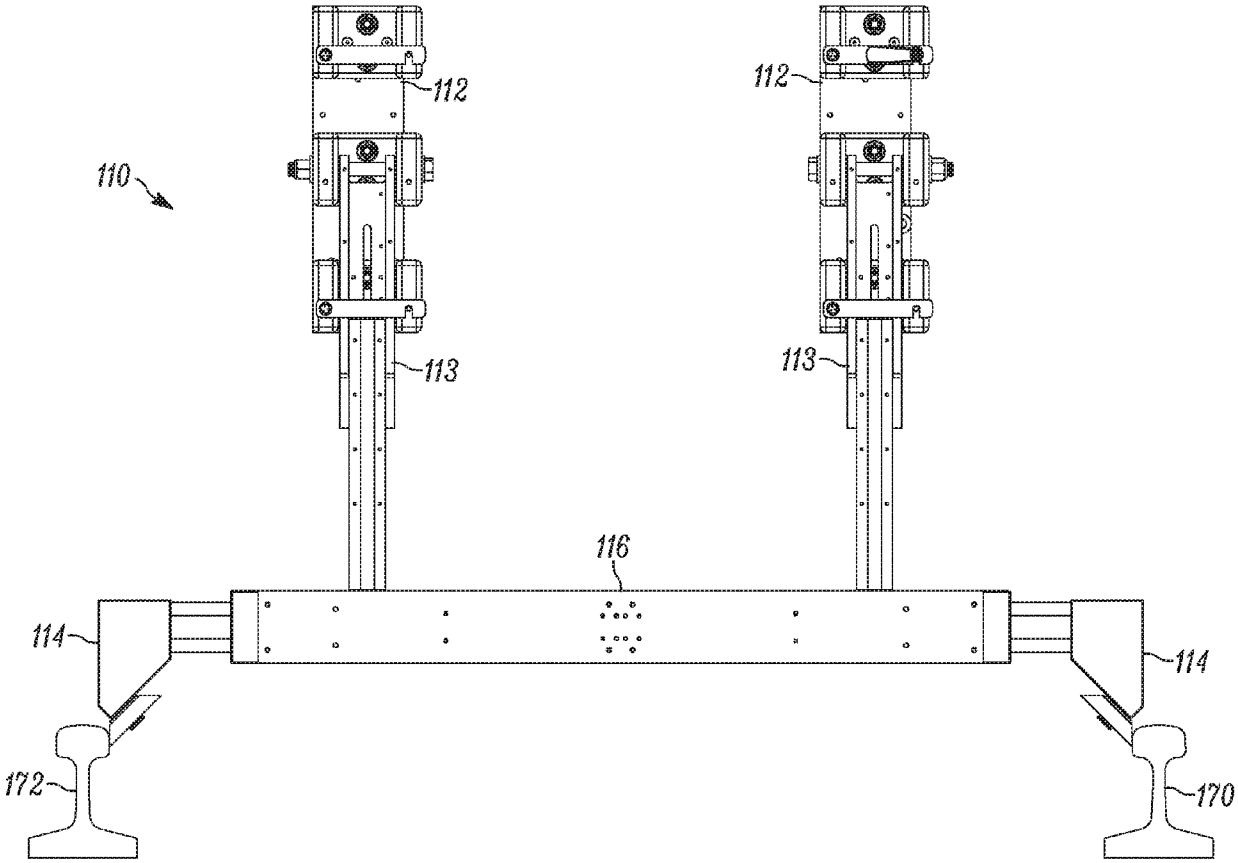
FIG. 2 is a front elevation view of the rail gauge measurement tool of the rail track geometry measurement system of FIG. 1.

The RGM 110 is mounted to the vehicle by the vehicle mount assembly 112 shown in FIG. 1. As shown in FIG. 2, the RGM 110 is be positioned on the vehicle such that the measuring wheel assemblies 114 contact the rails 170/172. The rails 170/172 are a pair of parallel metal structures that include a first rail or left rail 170 and a second rail or right rail 172. The pair of rails 170/172 form a rail track along which rail vehicles travel. The rail track rests upon a track bed. The track bed may be a structure comprising gravel, cement, asphalt, and/or packed earth that supports the rail track. In some embodiments, the track bed is a mound raised relative to the surrounding ground. In other embodiments, the track bed is level with the ground.

Returning to FIG. 1, the INM 102, location sensor 104, and ESM 108 can be mounted anywhere on the vehicle. For example, the INM 102 can be located high up on the vehicle, such as on the roof, in order to amplify the movement of the INM 102 caused by changed in orientation of the track (by placing the sensor far away from the track). Additionally, the location sensor 104 can be placed on the roof or near a window of the vehicle such that it can communicate with GPS satellites or cellular towers with less interference from the rest of the structure of the vehicle. In some embodiments, the user interface module 106 is a portable device, such as a tablet or smart phone, which is carried by a user riding in the vehicle. In other embodiments, the user interface module 106 may be a screen mounted in the interior of the vehicle where it can be monitored by the user.

The INM 102 is a module that contains sensors capable of measuring the orientation of the vehicle as it travels along the rails 170/172. The INM 102 includes rotational encoders or rotational sensors capable of measuring the pitch and yaw of the vehicle. These solid state gyroscope sensors are smaller, cheaper, and more accurate than traditional mechanical gyroscopes. In some examples, the INM 102 further contains one or more of motion sensors, accelerometers, odometers, encoders, magnetometer sensors, and GPS in order to calculate via dead reckoning the position, orientation, and velocity of the vehicle.

In some examples, the INM 102 provides integrated Roll, Yaw, GPS, odometer, encoder, accelerometer and magnetometer sensors. The INM uses information from one or more of a GPS sensor, a magnetometer, an odometer, an encoder, and/or pitch, roll and yaw sensors to calculate the position and other parameters of the truck via dead reckoning. In some examples, an odometer is used as an input in to the INM as a way to increase the accuracy of the location coordinates that the INM outputs to the controller PC. The INM 102 may operate in connection with software that uses sensor outputs of the INM 102 with the RGM 110 to calculate display and record track parameters, such as, gauge, gauge 20, gauge left, gauge right, warp 31, warp 62, cross level, degree of curvature, and the like.

The location sensor 104 can be any sensor capable of determining the location of the vehicle. In the embodiment shown in FIG. 1, the location sensor 104 is a GPS module. In alternative embodiments, the location sensor 104 can determine the location of the vehicle by triangulation using cellular towers or other beacons, calculating distance traveled based on measured speed and cross referencing with a map of the rail track being traveled, or any other way.

The user interface module 106 comprises a screen, light, or speaker capable of conveying information to a user and an input device capable of receiving data from the user. In the embodiment shown, the user interface module comprises a touchscreen device, such as a tablet or smartphone. In other embodiments the user interface module 106 comprises a personal computer, laptop, or other computing device. The user interface module 106 receives commands from the user and is in communication with the other elements of the system 100 in order to carry out those commands. For example, the user can enter a command into the user interface module 106 to lower or raise/stow the RGM 110. The user interface module 106 then transmits a signal to the lowering mechanism 113 which causes the RGM 110 to be lowered or raised/stowed. The user interface module 106 also displays data to the user as it is being collected. In some embodiments a processor or processing device either in the user interface module 106 or in another element of the system 100 processes the data and converts it to a format more easily understood by the user, such as graphs or models. In some embodiments, the user interface module further includes memory such that the user can go back and view previously collected data or store data as it is being collected such that he/she can view it later.

The ESM 108 includes a data acquisition module communicatively connected to one or more of the sensors described above, a processor or processing device, memory, and a transmitter. The data acquisition module receives the raw data from the sensors. This data is then processed by the processor and stored in memory. For example, the data acquisition module receives data from two linear sensors in the RGM 110, the processor then processes this data to calculate the overall rail gage or track geometry. The processed data is then transmitted by the transmitter to the user interface module 106 and/ or the remote server 101. The transmitter can be a short range wireless transmitter, such as a WiFi or Bluetooth® chip, for communication with the user interface module 106, a long range wireless transmitter capable of communication with a cellular tower or satellite in order to transmit data to the remote server 101, or a wired connection such as an Ethernet router.

In some embodiments, one or more of the elements of the ESM 108 described above are separated out of the ESM 108 to be free standing modules or combined with other modules in the system 100. For example, the memory and/ or processor can be removed from the ESM 108 and implemented into the system as a free standing processing unit. Alternatively, the memory and processor can be integrated into the user interface module 106 or the remote server 101. Similarly, the data acquisition module or transmitter can be removed from the ESM 108 such that they are free standing elements within the system 100 or be built into other elements.

Figure 8:
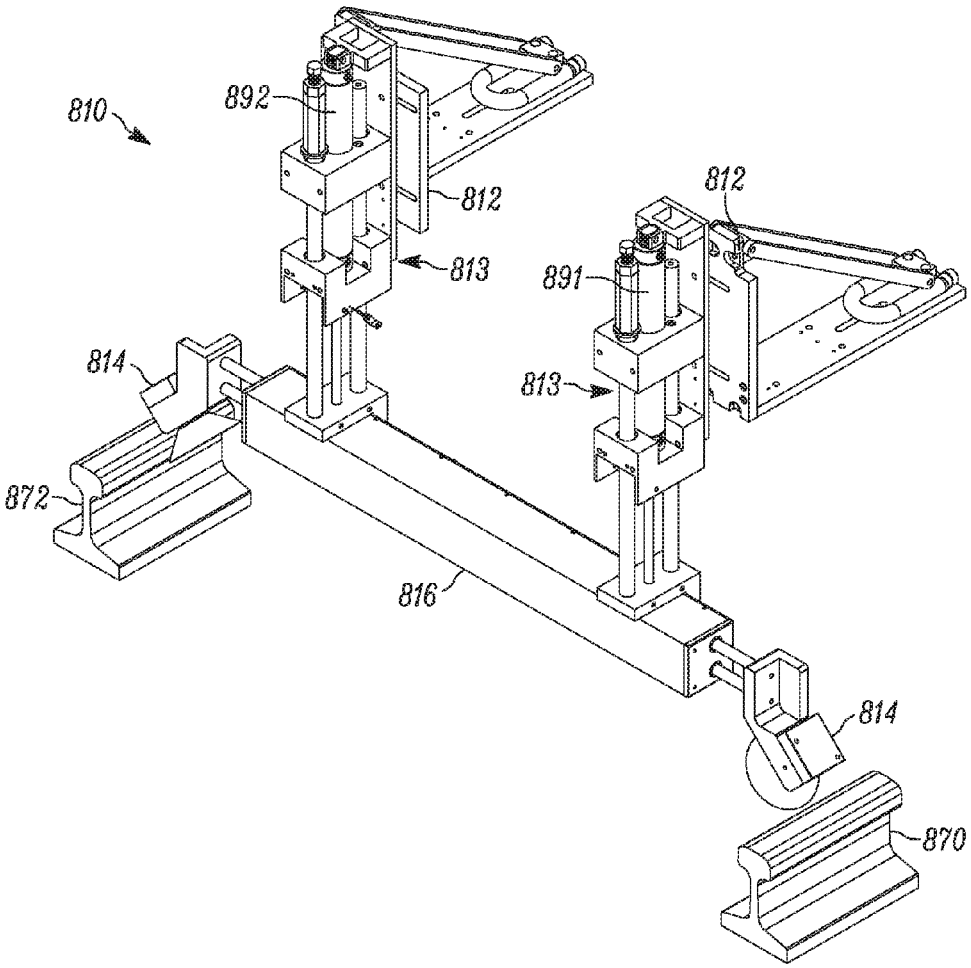
FIG. 8 shows a rail gage measurement tool with pneumatic lowering mechanism according to examples described in this application.

The vehicle mounting assembly 112 includes a lowering mechanism 113. In the embodiment shown, the lowering mechanism 113 comprises a pair of air cylinders (as shown in FIG. 8 and described in more detail below) or actuators which can be activated by the user to lower the RGM 110 until it is in contact with the rails. In other examples, other types of actuators, such as ball screws or hydraulic pistons, can be used to raise and lower the RGM 110. In still other examples, the lowering mechanism 113 is a mechanical mechanism by which a user manually raises or lowers the RGM 110 by hand, upon exiting the vehicle.

Figure 3:
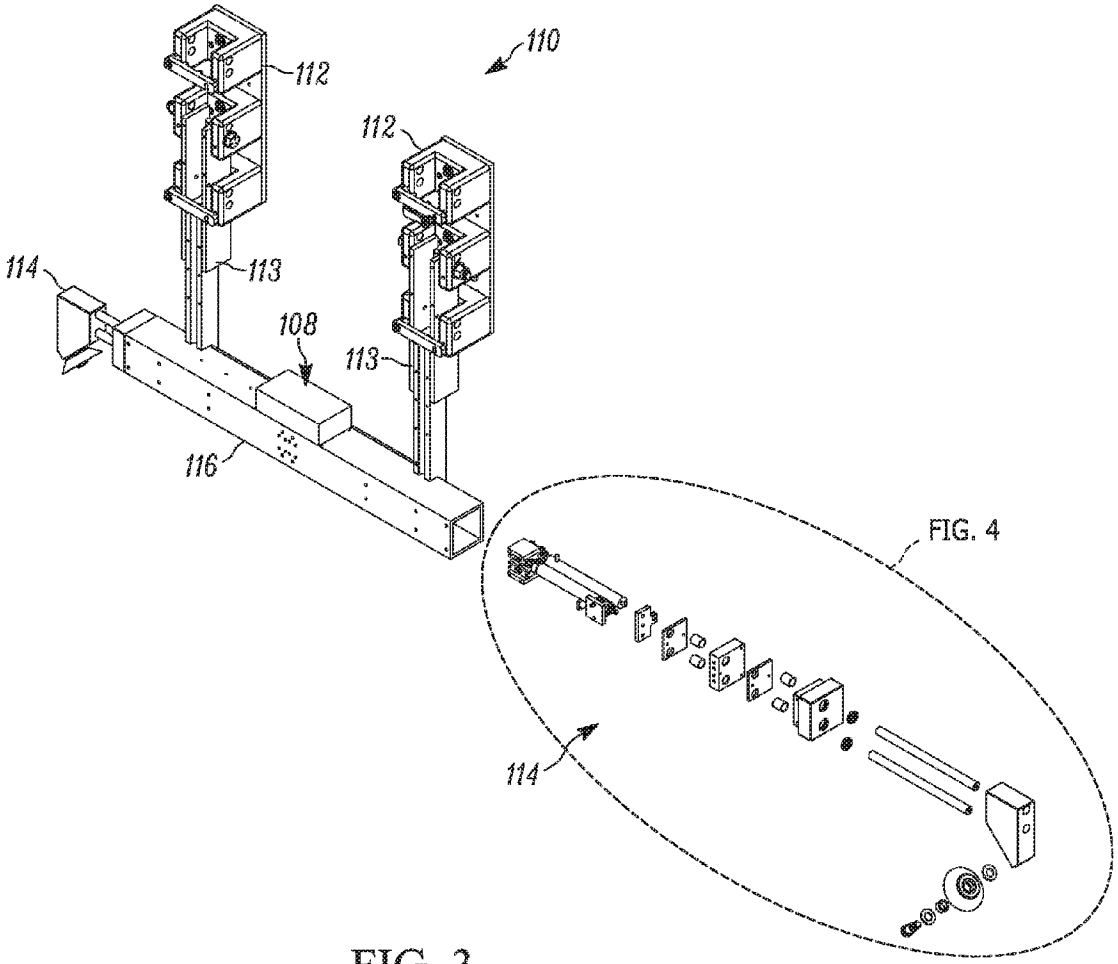
FIG. 3 illustrates the rail gauge measurement tool of FIG. 2 with one side exploded to show the internal components.
Figure 4:
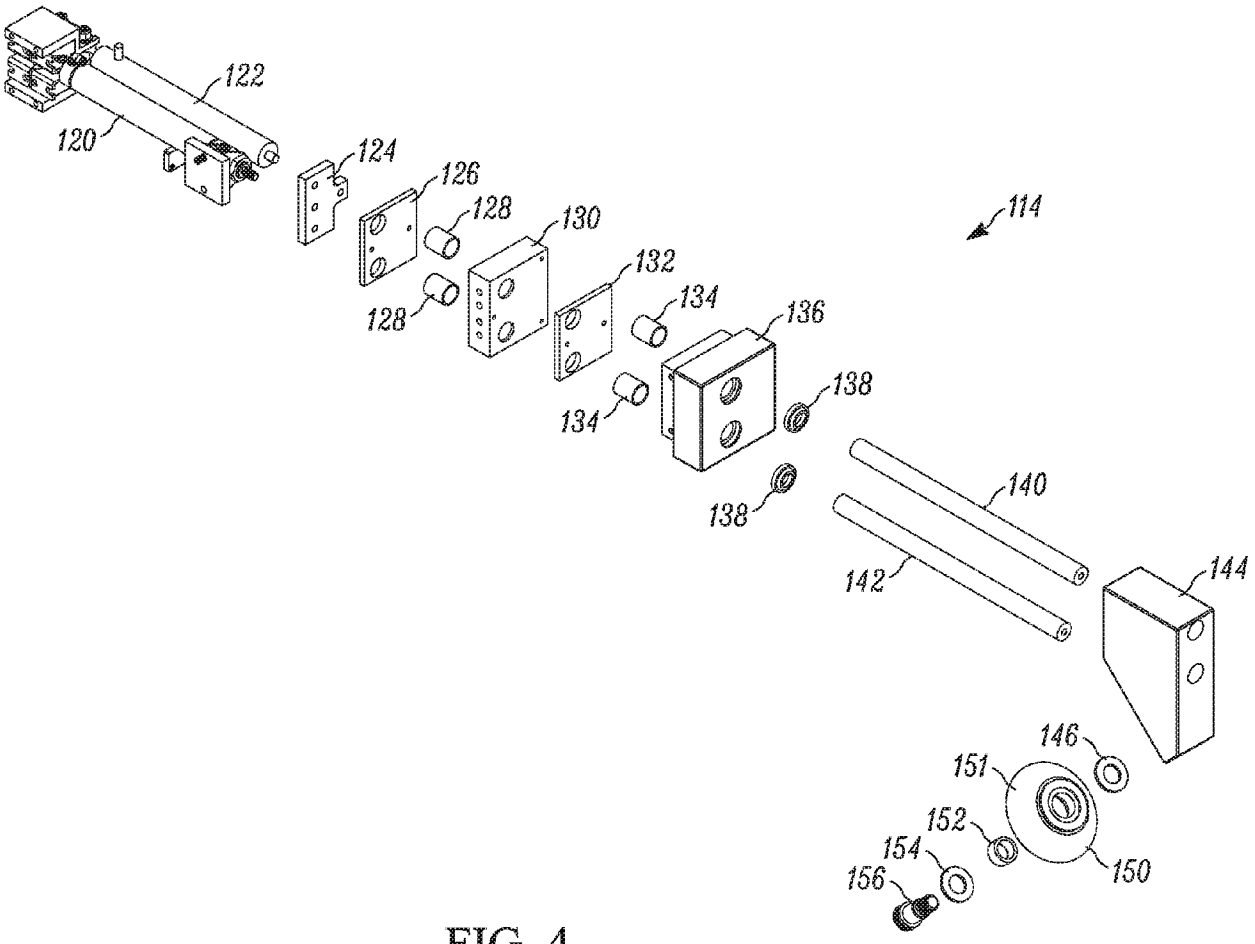
FIG. 4 shows an expanded view of the exploded portion of the rail gauge measurement tool of FIG. 3.

The RGM 110 includes a pair of measurement wheel assemblies 114 which are slidably mounted to a body 116. FIGS. 3-4 provide exploded views of the internal components of the RGM 110 comprising a measurement wheel assembly 114. The measurement wheel assembly 114 comprises a rail contacting element 150. In the depicted embodiment, the rail contacting element 150 is a wheel having an annular rim 151. The rail contacting element 150 is attached to a mounting block 144 by a bolt 156. A plurality of bearings 146/152/154 are positioned between the rail contacting element 150 and the bolt 156 and mounting block 144 in order to allow the rail contacting element 150 to rotate with minimal resistances as it travels along the surface of the rail 170. In one form, the rail contacting element 150 is able to rotate with minimal resistance so as to reduce friction between the RGM 110 and the rails 170/172. This reduction in friction reduces the wear on the rail contacting element 150 and reduces the likelihood of the RGM 110 bending or breaking.

The mounting block 144 is attached to a pair of parallel connecting shafts 140/142. The first connecting shaft 140 and second connecting shaft 142 provide increased rigidity compared to a single shaft design. This increased rigidity in turn allows for higher accuracy measurements by the RGM 110. The connecting shafts 140/142 are attached to a bi-directional air cylinder 120 and linear sensor 122 via a series of plates, blocks, and bearings 124-138. In the embodiment shown, the connecting shafts 140/142 are connected to an outer bearing mount block 136 by a pair of shaft seats 138. The outer bearing mount block 136 is attached to an inner bearing mount block 130 by a pair of outer composite sleeve bearings 134. The outer composite sleeve bearings 134 are held in place by an outer bearing retention plate 132. The inner bearing mount block 130 is attached to an electrically nonconductive plate 124 by a pair of inner composite sleeve bearings 128. The inner composite sleeve bearings 128 are held in place by an inner bearing retention plate 126. The bi-directional air cylinder 120 and linear sensor 122 are in turn connected to the electrically nonconductive plate 124. This is merely intended as an illustrative example. In other versions, the air cylinder 120 and linear sensor 122 can be attached to the parallel connecting shafts 140/142 via other arrangements and configurations.

The air cylinder 120 is operable to exert a force along the primary tool axis of the RGM 110, the axis along which the shafts 140/142 extend, in order to bias the rail contacting element 150 towards the rail 170. This biasing force causes the rail contacting element 150 to remain in contact with the rail 170 as the gage of the tracks changes.

The electrically nonconductive plate 124 is positioned between the linear sensor 122 and the rail contacting element 150 in order to electrically isolate the linear sensor 122. In operation, the relative movement of the rail contacting element 150 to the rail 170 or the components of the measurement wheel assembly 114 and the body 116 may generate a charge of static electricity. Alternatively, the rail 170 may have an electrical charge that can be conducted by the rail contacting element 150. If either of these charges were conducted to the linear sensor 122 it could damage the sensor 122 or throw off the readings.

The bi-directional air cylinder 120 and the linear sensor 122 can be arranged so that they are adjacent and parallel (or essentially parallel) to each other. In some examples, the air cylinder 120 and linear sensor 122 can be situated parallel to one another in a first plane that is offset by 90 degrees (e.g., perpendicular) to a second plane on which the parallel connecting rods 140/142 reside. In some examples, the offsetting of the first plane and second plane by 90 degrees positions the air cylinder at the midpoint of the second plane. This arrangement reduces friction and increases rigidity, which in turn may improve the accuracy and lifespan of the RGM 110. In the embodiment shown, the first plane (containing the air cylinder 120 and the linear sensor 122) is a horizontal plane running generally parallel with the rail track, and the second plane (containing the parallel connecting rods 140/142) is a vertical plane running generally perpendicular to the rail track.

Having the air cylinder 120 and linear sensor 122 be parallel instead of concentric allows for the use of higher quality or more accurate linear sensors 122 because it allows space for a larger sensor. Having a parallel air cylinder 120 and linear sensor 122 also reduces the amount of force applied to either component which extends the service life and improves the reliability of the RGM 110.

A second measurement wheel assembly 114, which is a mirror image of the first measurement wheel assembly 114 shown in FIG. 4, is located on the other side of the body 116 and contacts the second rail 172.

In some embodiments, the linear sensor is of a linear variable inductive transformer (LVIT) construction. LVIT sensors measure the variation in voltage induced between a plurality of coils as the coils move relative to each other as a result of rail contacting element 150 moving relative to the body 116.

In operation, the user or operator activates the lowering mechanism 113 to lower the RGM 110 until the first and second rail contacting elements 150 contact the first and second rails 170/172. The user may be prompted to input other relevant data into the system 100 via the user interface 106 such as the current location or the current user. Once the RGM 110 is lowered, it initiates a calibration and a self-check routine in which the air cylinder 120 and the linear sensor 122 are set based on the preferable track gage.

Data collected from the first and second linear sensors 122 represents the track gage, or the distance between the two rails 170/172. This data can be collected by the ESM 108 as the vehicle travels along the track at between 2 mph and 45 mph, for example. The 45 mph max speed is set by United States law, the rail geometry measurement system 110 is capable of collecting data at higher speeds where permitted by law. The ESM 108 also collects data from the location sensor 104 and stores the data in memory. The ESM 108 correlates the data from the location sensor 104 and the data from the RGM 110, such as by storing each with a timestamp from an internal clock, so that location of each track gage measurement is known.

The ESM 108 further collects data from the INM 102 representing the orientation of the vehicle. As above, the ESM 108 correlates the data from the INM 102 to the data from the location sensor 104 taken at the same time such that the orientation of the vehicle at each location is known. The data collected by the ESM 108 is transmitted to the user interface 106 and displayed to the user in real time. The data collected by the ESM 108 is also transmitted to a remote server 101 where it can be stored in order to be reported and analyzed.

In some embodiments, the server 101 compares the data received to stored data from previous measurements of the same rail tracks. The comparison can flag changes in rail track geometry before the geometry fall outside of safety parameters. This allows for preventative maintenance to be performed to prevent additional deformation of the rails.

Figure 5:
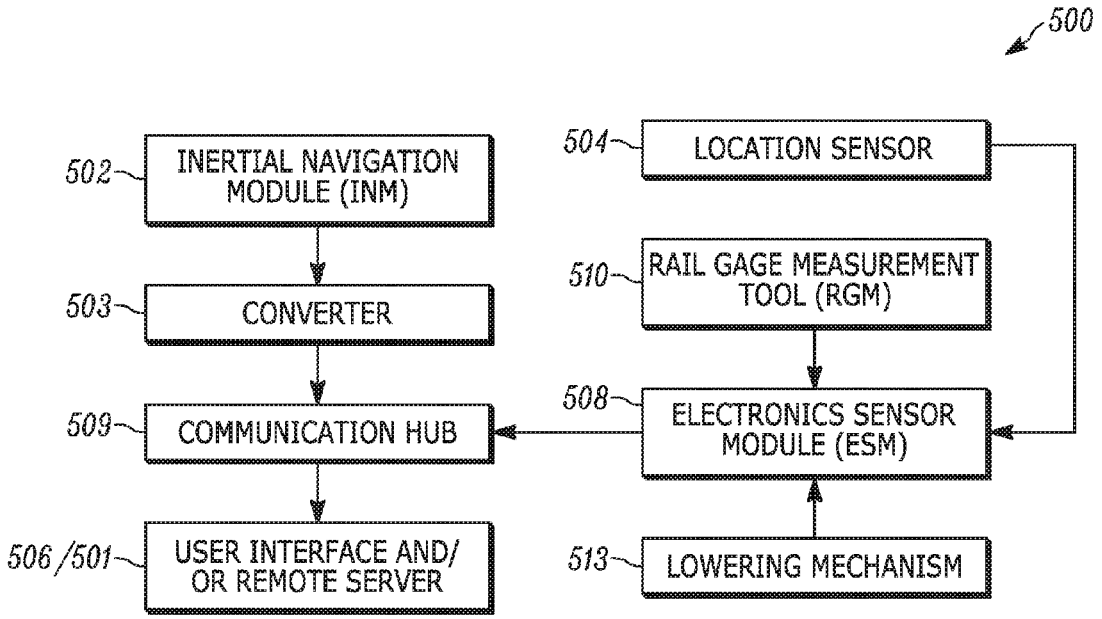
FIG. 5 shows a system diagram of a rail track geometry measurement system according to examples described in this application.
Figure 6A:
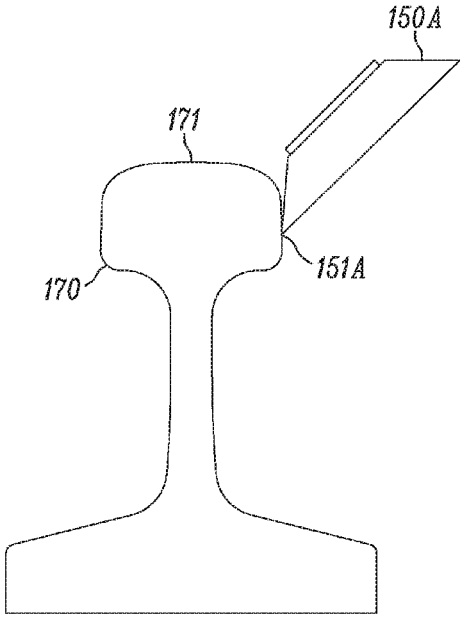
FIGS. 6A-6D show four measuring wheels used in accordance with four examples described in this application.
Figure 6B:
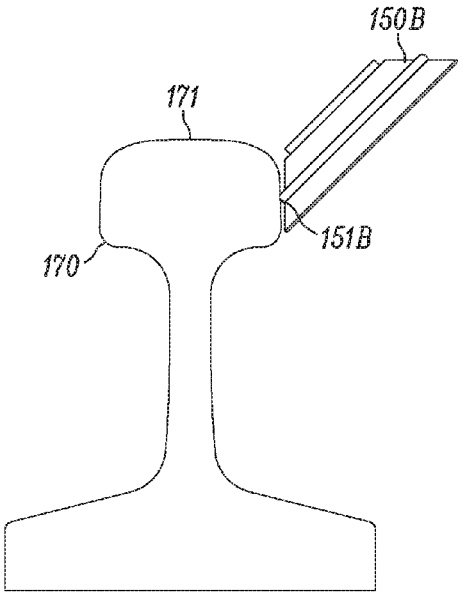
Figure 6C:
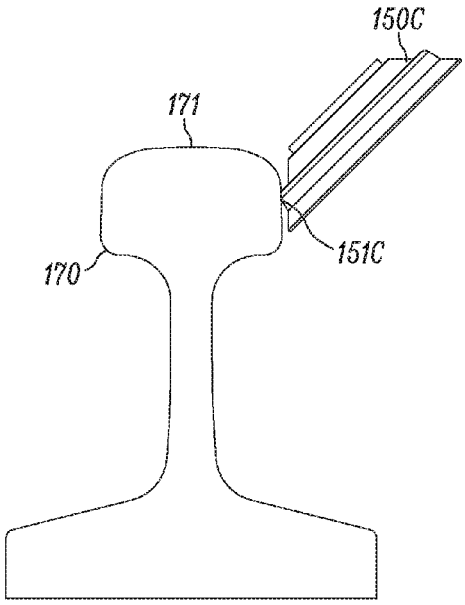
Figure 6D:
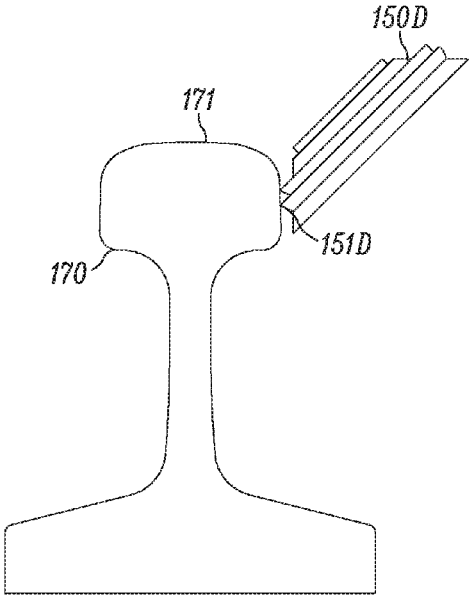

FIG. 5 illustrates a system diagram of a track geometry measuring system 500 according to one example of the present disclosure. The track geometry measuring system 500. FIG. 5 comprises modules that may be associated or used in connection with certain components of the rail geometry measurement system 100 discussed above. For example, FIG. 5 shows a remote sensor 501, an INM 502, a location sensor 504, a user interface 506, an ESM 508, an RGM 510, and a lowering mechanism 512. These modules may correspond, respectively, with the remote sensor 101, the INM 102, the location sensor 104, the user interface 106, the ESM 108, the RGM 110, and the lowering mechanism 113 described above with respect to FIGS. 1-4. Except where expressly differentiated, the corresponding elements of FIG. 5 are presumed to operate the same across multiple embodiments.

The track geometry measuring system 500 includes an RGM 510 in communication with an ESM 508. The ESM 508 further collects data from a location sensor 504 and the lowering mechanism 513. In some forms, the ESM 508 is configured to use the data from the location sensor 504 and lowering mechanism 513 to only collect data from the RGM 510 when the RGM 510 is lowered to engage the rails 170/172 and the vehicle is moving. This helps avoid the system 500 memory from being wasted storing useless data. In the depicted embodiment, the location sensor 504 is a GPS module. In some embodiments, the location sensor 504 can include a speedometer to more accurately determine when the vehicle is moving for the purpose of activating or deactivating data collection. In other formats, the location sensor 504 can include other or additional sensors or sensing equipment that can be used to determine a location of the sensor 504, for example, via the use of radio signal triangulation techniques, lasers, or other tracking devices. The data collected from the location sensor 504 can further be used to control how often data is recorded from the RGM 510 and ESM 508 based on the speed of the vehicle.

The ESM 508 transmits the data collected to a user interface 506 and/or a remote server 501 via a communication hub 509. In some embodiments, the communication hub 509 is an Ethernet router. In other embodiments, the communication hub 509 is a wireless router or wireless card.

In some examples, the INM 502 can be configured to communicate directly with the user interface 506 and/or remote server 501 via a converter 503 and the communication hub 509 instead of communicating with the ESM 508. In other examples, the INM 502 communicates with the ESM 508 which in turn communicates with the user interface 506 and/or remote server 501.

In operation, the vehicle travels along a track having parallel rails. The orientation of the track, including the rotation about at least two axes (pitch and yaw) is measured with inertial navigation sensor 502. The location of the vehicle is measured using the GPS sensor or location sensor 504. The RGM 510 measures the geometry of at least one rail of the track, and this measurement is transmitted to the remote server 501. As described above, the RGM 510 measures the geometry of at least one rail by biasing a rail contacting element 150 towards the rail and then measuring the linear movement of the rail contacting element 150 along an axis perpendicular to the rail.

FIGS. 6A-6D illustrate alternative embodiments for the rail contacting element 150. The rail 170 is contacted by the rail contacting element 150A-D on the side 0.5"-1" below the crown 171. In the embodiments shown, the rail contacting elements 150A-D contact the rail 170 at a location 0.625" below the crown 170. The contact points on the annular rim 151A-B are spaced below the crown in order to reduce the effects of superficial irregularities. Superficial irregularities are deformations of the rail 170 that do not affect the overall safety of the tracks. One common example of a superficial irregularity is a burr that frequently forms along the crown 171 of the rail 170. If the rail contacting elements 150A-D were to contact this burr the RGM 110 would read the gage of the tracks as being greater than it actually is.

The rail contacting elements 150A-D are also designed to have minimal surface area at the contact points on the annular rim 151A-D. This can be achieved by angling the annular rim 151A such that only a single point makes contact while the majority of the annular rim 151A is spaced away from the rail 170. Alternatively, one or more beads or flange portions can be built into the annular rim 151B-D such that only the outermost point of the beads or flanges make contact with the rail 170. As discussed above, this is intended to minimize friction between the RGM 110 and the rail 170 in order to extend the service life of the RGM. The minimized surface area also serves to reduce the effect of superficial irregularities. Any superficial irregularity that contacts the rail contacting elements 150A-D can negatively impact the accuracy of the gage measurement. Reducing the point of contact reduces the likelihood that any superficial irregularities of the rail will make contact with the contacting elements 150A-D.

Figure 7:
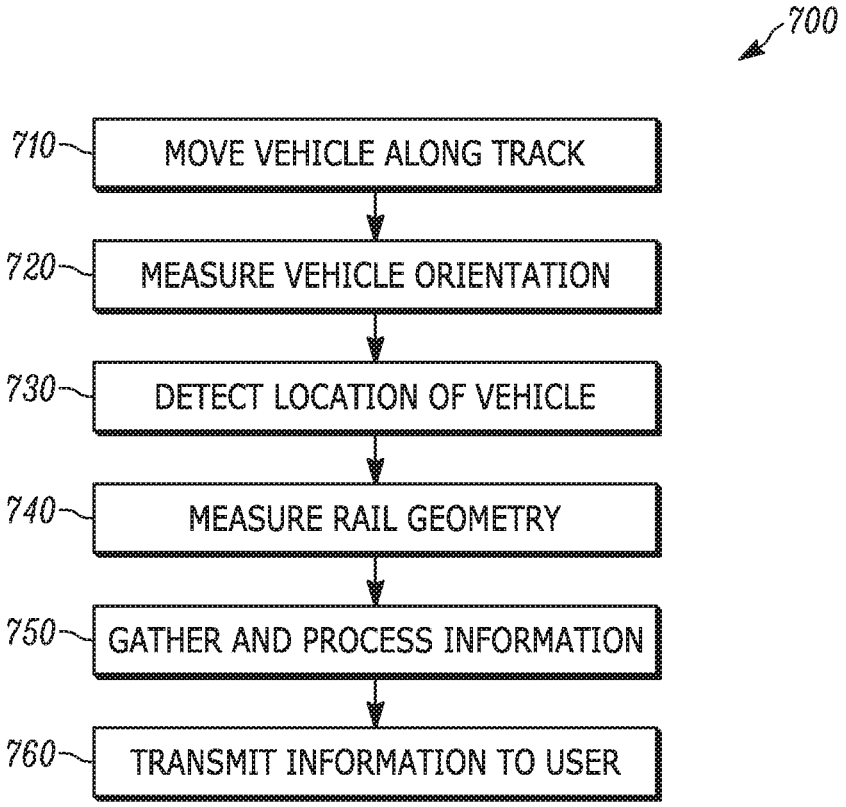
FIG. 7 is a flow diagram illustrating a method of measuring rail track geometry according to example described in this application.

Certain aspects of the present application also relate methods for measuring rail track geometry. FIG. 7 is a flow diagram demonstrating one such method 700, which includes moving 710 a vehicle along a track that has parallel rails. Sensors and other equipment are used to measure various parameters relating to operating conditions are measured of the rail and/or the railway track. For example, an inertial navigation sensor may be used to measure 720 the orientation of the vehicle about multiple axes, and a location sensor (e.g., a GPS unit) can be used to measure or detect 730 the location of the vehicle. A rail geometry measuring unit (e.g., the RGM unit described above) measures 740 the geometry of one or more rails of the track. The measurement of the rail geometry may include contacting at least one of the rails with a rail contacting element (e.g., measuring wheels), biasing the rail contacting element towards the rail (e.g., with an air cylinder), and measuring with a linear sensor the linear movement of the rail contacting element along an axis perpendicular to the rail. A processor gathers and processes 750 the information, and then transmits 760 the information (e.g., via a wireless transceiver) to a user interface or other display, whereby a user can receive and respond to the information.

The processing of the information can occur via a variety of methods or techniques. In some forms, the processing can occur by way of the operation of particular software or computer applications. In some examples, the software may operate as described herein. First, an inspection process begins with inputting the speed limit information for the track to be inspected in to the software. The speed limit information can be entered automatically or manually. A user may then place a vehicle onto a rail and deploy an RGM assembly by pressing an operator on the software interface. The operator may then begin the measuring process by interface an operator on the interface. The software will then graph track parameters on a screen of the interface. The graphing function of individual parameters in the software can be user selectable so that the graphs lines for individual parameters can be turned on and off by the user. In some formats, the X axis of the graph will show, for example, milepost information in 1/10 of a mile increments. The milepost display on the X axis may increase or decreased based on the stored response from the operator indicating the direction of travel.

The software can be configured to continuously monitor degree of curvature to determine if the truck is on tangent, spiral or curved track. The software may also be configured to compare the track parameters to acceptable limits. When a parameter exceeds a predetermined limit, the software is configured to place a mark the measurement line on the graph and record the defect details in a log file. By selecting, via the user interface, a mark on the graph, the software can open a window up to show the log entry information. When an operator passes track feature, the operator may elect to activate an operator button, thereby triggering the software to mark the location of the with the features. When this function is activated the software will make an entry to a log file and place a corresponding marker on the graph.

When the operator passes through a switch (also known as a turnout) the operator may elect to press a button to retract the sensor wheels so that they are not damaged. Once through the switch the operator may then press a button or activate an operator on the user interface to extend the measuring wheels. The software may suspend the graph and defect detection operations while the measuring wheels are retracted, but all other measurements may continue normally. Each operator activation can be entered into a log and stored in a data file. The graph may then show a symbol where the suspended data is omitted by indicating the start and end of the switch (as indicated by the operator key press or other activation). When the operator reaches the ending mile post, the can press a button or otherwise execute another operator that activates the software to stop the measuring process.

FIG. 8 shows a rail gage measurement tool 810 with pneumatic lowering mechanism 813. The RGM tool 810 of FIG. 8 comprises components that may correspond with the components of the system 100 of FIGS. 1-5. Elements having the same final two digits of their reference number as elements in other embodiments are presumed to be equivalent to the components depicted in FIGS. 1-5 unless specifically differentiated. The lowering mechanism 813 comprises a pair of air cylinders 891/892 that are actuated to raise or lower the body 816 relative to the vehicle mount assembly 812. When the body 816 is lowered, the measuring wheel assemblies 814 contact the rails 870/872. When the air cylinders 891/892 are activated in the other direction the body 816 is raised and stowed. In operation, the body 816 is kept in the stowed position when not being used to measure rail gage so reduce the risk of striking the ground or any other obstacle and being damaged.

The present application describes preferred embodiments and other examples of rail track geometry measurement equipment and related methods of use. Those skilled in the art will recognize that a wide variety of modifications, alterations, and combinations can be made with respect to the embodiments described herein without departing from the scope of the invention as set forth in the claims, and that such modifications, alterations, and combinations are to be viewed as being within the ambit of the inventive concept. It should also be understood that select features of one or more embodiments may be combined with select features of other embodiments to provide yet further embodiments, as desired. All references cited in this application are hereby incorporated by reference in their entirety.

The invention claimed is:

1. A rail gauge measurement tool comprising:

a frame configured to mount the rail gauge measurement tool to a rail vehicle, a first rail engagement unit configured contact a first rail of a rail track, the first rail engagement unit being movable relative to the frame and comprising a first rail contacting element and a first plurality of parallel connecting shafts extending along a tool axis;

a first air cylinder coupled to the first rail engagement unit and configured to exert a biasing force along the tool axis so that the first rail engagement unit maintains contact with the first rail as the rail gauge measurement tool travels along the rail track; and a first linear sensor configured to measure movement of the first rail engagement unit relative to the frame.

2. The rail gauge measurement tool of claim 1, wherein the first linear sensor and the first air cylinder extend parallel to one another along a first plane, wherein the first plurality of parallel connecting shafts extend parallel to one another along a second plane, wherein the first plane is not parallel to the second plane.

3. The rail gauge measurement tool of claim 2, wherein the first plane is a horizontal plane running generally parallel with the rail track, and wherein the second plane is a vertical plane running generally perpendicular to the rail track.

4. The rail gauge measurement tool of claim 1, wherein the first rail contacting element comprises a measuring wheel configured to engage with the first rail as the rail gauge measurement tool travels along the rail track.

5. The rail gauge measurement tool of claim 4, wherein the measuring wheel comprises at least one annular rim, wherein the annular rim is configured to reduce the surface area of wheel surface that contacts the first rail, and to space a majority of the wheel away from the first rail as the rail gauge measurement tool travels along the track.

6. The rail gauge measurement tool of claim 5, wherein the measuring wheel is configured to inhibit superficial irregularities in the first rail from affecting the measurements obtained by the rail gauge measurement tool.

7. The rail gauge measuring system of claim 5, wherein the measuring wheel is configured to contact the first rail at a point lower than one half of an inch below a crown of the first rail.

8. The rail gauge measurement tool of claim 1, further comprising a housing coupled to the frame and extending along the tool axis, wherein the first air cylinder, the first linear sensor, and at least a portion of the first parallel connecting shafts of are positioned within the housing, and wherein the first rail contacting element is positioned outside of the housing.

9. The rail gauge measurement tool of claim 8, further comprising:

a second rail engagement unit configured contact a second rail of the rail track, the second rail engagement unit being movable relative to the frame and comprising a second rail contacting element and a second plurality of parallel connecting shafts extending parallel to one another in the second plane;

a second air cylinder within the housing and coupled to the second rail engagement unit, the second air cylinder configured to exert a biasing force along the tool axis so that the second rail engagement unit maintains contact with the second rail as the rail gauge measurement tool travels along the rail track; and a second linear sensor configured to measure movement of the second rail engagement unit relative to the frame;

wherein the second linear sensor and the second air cylinder extend parallel to one another along the first plane, and wherein the first plane is not parallel to the second plane.

10. The rail gauge measurement tool of claim 9, further comprising a processing device in communication with at least the first linear sensor and the second linear sensor, wherein the processing device receives data from the first linear sensor and the second linear sensor and calculates rail geometry based on the data.

11. The rail gauge measurement tool of claim 9, further comprising a bearing retention unit coupling the first air cylinder and the first linear sensor to the first rail engagement unit, the bearing retention unit comprising an inner bearing plate and an outer bearing mounting block coupled to the inner bearing plate, the inner bearing retention plate having apertures corresponding to protrusions extending from the first air cylinder and the first linear sensor, the mounting block having a plurality of sleeves configured to receive each of the first parallel connecting shafts of the first rail engagement unit.

12. The rail gauge measurement tool of claim 11, wherein the inner bearing plate comprises a non-electrically conductive inner surface so that the first rail contacting element is electrically isolated from the second rail contacting element.

13. The rail gauge measurement tool of claim 1, further comprising an electronic sensor module having a processing device in communication with at least one remote sensor positioned relative to the rail vehicle, the at least one remote sensor configured to monitor information pertaining to at least one of the rail vehicle and the rail track.

14. The rail gauge measurement tool of claim 13, further comprising a user interface module in communication with the electronic sensor module, the user interface module having a display, wherein the electronic sensor module is configured to receive and process data received from the first linear sensor and data from the at least one remote sensor, and to communicate the processed data to the user interface module, and wherein the interface module is configured to display information that is based at least in part on the processed data communicated from the processing device.

15. The rail gauge measurement tool of claim 14, further comprising:

an inertial navigation module in communication with the electronic sensor module, the inertial navigation module configured to measure the orientation of the vehicle; and a location sensor in communication with the electronic sensor module, the location sensor comprising a global positioning system component configured to detect the location of the vehicle;

wherein the electronic sensor module is further configured to receive and process data received from the inertial navigation sensor and the location sensor, and to communicate the processed data to the user interface module.

16. A rail track geometry measurement system configured to install relative to a rail vehicle travelling along a railway track, the system comprising:

an inertial navigation module configured to measure the orientation of the vehicle;

a location sensor configured to detect the location of the vehicle; and a geometry measurement tool comprising:

a frame configured attaching the tool to the rail vehicle a rail engagement unit moveable relative to the frame, the rail engagement unit configured to maintain contact with a rail as the rail vehicle travels along the railway track; and a linear sensor configured to sense movement of the at least one rail contacting element;

a processor in communication with the inertial module, the location sensor, the geometry measurement tool, the processor further configured to communicate with a remote data server and a user interface module installable on the rail vehicle;

wherein the processor is configured to receive and process data from the inertial navigation module, the location sensor, and the geometry measurement tool, and to transmit the processed data to for display via the user interface module.

17. The system of claim 16, wherein the geometry measurement tool further comprises an air cylinder coupled to the rail engagement unit and configured to exert a biasing force so that the first rail engagement unit maintains contact with the rail as the rail vehicle travels along the railway track, the air cylinder extending parallel to the linear sensor in a first plane, wherein the rail engagement unit comprises a rail contacting element and a plurality of parallel connecting shafts extending from the rail contacting element, the parallel connecting shafts extending parallel in a second plane that are traverse to the first plane.

18. The system of claim 16, further comprising an electronic sensor module in communication with the inertial navigation module, the location sensor, and the geometry measurement tool, the electronic sensor module configured to communicate with at least one additional sensor installed on the rail vehicle.

19. The system of claim 16, wherein the inertial navigation system comprises a solid state gyroscope that measures rotation about at least two axes.

20. A method of measuring rail track geometry comprising:

moving a vehicle along a track having parallel rails;

measuring the orientation of the vehicle about at least two axes with an inertial navigation sensor;

measuring the location of the vehicle with a GPS sensor;

measuring the geometry of at least one rail of the track; and transmitting the measurements to a remotely located server, wherein the measuring the geometry comprises contacting at least one of the rails with a rail contacting element, biasing the rail contacting element towards the rail, and measuring the linear movement of the rail contacting element along an axis perpendicular to the rail.

* * * * *